United States Patent [19]

Zamborsky

[11] 3,983,998

[45] Oct. 5, 1976

[54] PACKAGING ARRANGEMENT FOR LONG DISTANCE TRANSPORTATION OF HIGH VOLTAGE IMPREGNATED PAPER INSULATED CABLE

[75] Inventor: Nicholas Alden Zamborsky, Pompton Plains, N.J.

[73] Assignee: The Okonite Company, Ramsey, N.J.

[22] Filed: Jan. 15, 1976

[21] Appl. No.: 649,497

[52] U.S. Cl. ..... 206/398; 206/399

[51] Int. Cl.[2] ..... B65D 85/04

[58] Field of Search ..... 206/398, 399, 410, 389; 53/32; 242/159

[56] References Cited

UNITED STATES PATENTS

| | | | |
|---|---|---|---|
| 2,678,863 | 5/1954 | Atkinson et al. | 206/399 |
| 3,381,812 | 5/1968 | Cohen | 206/398 |

*Primary Examiner*—George T. Hall

*Attorney, Agent, or Firm*—Stephen B. Judlowe; James M. Rhodes, Jr.

[57] ABSTRACT

A packaging arrangement is shown herein for protecting high voltage, pipe-type, impregnated paper insulated cable during long distance shipping. An annular channel is provided along the inside radial face of a cable reel to receive first and second vapor barrier blankets which may comprise laminated layers of polyolefin, aluminum foil and polyethlene. An adhesive is spread throughout the open portion of the channel. A first steel banding wire annularly secures the first two blankets within the annular channel and a synthetic rubber adhesive is disposed over the two blankets and wire. A third blanket comprising a laminate of polyvinyl chloride and Nylon is then disposed over the composite formed up to this point and a second banding wire is tightly secured about the overall composite. The second wire is so positioned as to bear down in a plane extending generally parallel to the radius of the circle described by the first wire so as to be axially spaced therefrom. Finally, an Aluminum Cold Spray layer having a thickness of some thirty to forty mils and including methylethylketone, acetone and metallic solids is disposed over the entire arrangement. A wooden enclosure is then provided circumferentially about the reel.

10 Claims, 4 Drawing Figures

PACKAGING ARRANGEMENT FOR LONG DISTANCE TRANSPORTATION OF HIGH VOLTAGE IMPREGNATED PAPER INSULATED CABLE

BACKGROUND OF THE INVENTION

The present invention relates to the packaging of reels of cable and, more specifically, relates to the packaging of high voltage, pipe-type, impregnated paper insulated cable stored on a reel for overseas shipment.

High voltage, pipe-type, impregnated paper insulated cable must be protected against moisture pick-up during transportation. Indeed, this type of cable must be protected from moisture throughout its useful life. It is for this reason that such cable is generally protected within a completely enclosing pipe-like structure in the field.

When the cable is transported domestically, generally by truck or train, the cable reel is hermetically sealed within a metal shipping reel. The heremetic seal usually consists of a composite covering which is sealed to the metal reel after the cable is in place.

However, when this type of cable must be shipped overseas by marine transportation, the cable is, of course, most susceptible to the picking up of moisture. Currently, a continuous temporary lead is directly applied to the cable or the cable is enclosed in a steel reel which is completely enclosed by welding after the cable is on place on the reel.

Both of these methods for packaging such cable for marine transportation encounter economic disadvantages as well as frequent failures.

The present inventor has developed a new packaging arrangement for marine transportation which has been actually tested under severe marine conditions involving the shipment of impregnated paper insulated cable to the Far East from mainland U.S.A. The initial shipments which comprised experimental testing proved that the inventor's new arrangement is remarkably effective, and overcomes the objections to the previously used packaging methods and arrangements.

OBJECTS AND SUMMARY OF THE INVENTION

It is therefore an object of the present invention to provide a method and arrangement for packaging impregnated paper insulated cable for marine shipment which method and arrangement are more effective and economical than those currently used in such arrangements. Other objects of the invention will become apparent upon a reading of the following specification.

At least some of the objects of the present invention are achieved by the provision of a series of vapor barrier blankets comprising various laminated plastics and secured by two steel wires urging downwardly on the blankets and into an annular channel mounted on the inside radial face of a shipping reel.

BRIEF DESCRIPTION OF THE DRAWINGS

While the specification concludes with claims which particularly point out and distinctly claim the present invention, the following detailed description may be best understood when read in conjunction with the accompanying drawings in which:

DETAILED DESCRIPTION OF THE PREFERRED EMBODIMENT

Figure 1:
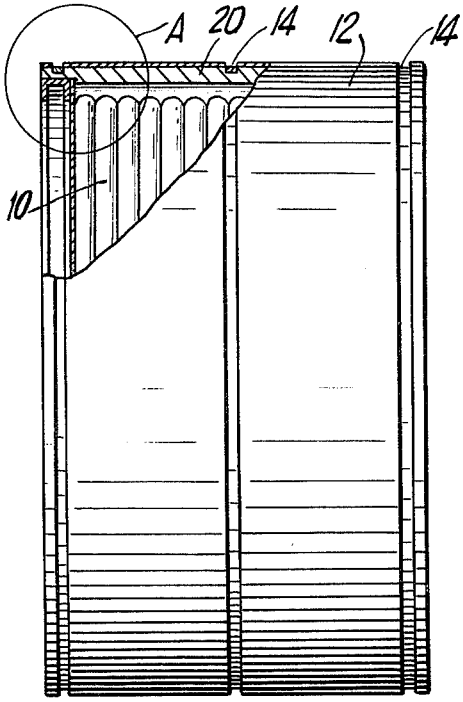
FIG. 1 is a cut away view of cable packaged in accordance with the present invention.

Referring now to the drawings in which like numerals are used to indicate like parts throughout the various views thereof, FIG. 1 shows a cut away view of an overall cable packaging according to the present invention.

As can be seen, cable 10 is enclosed within a wooden casing 12 which, in turn, is held in place by metal straps 14.

Figure 2:
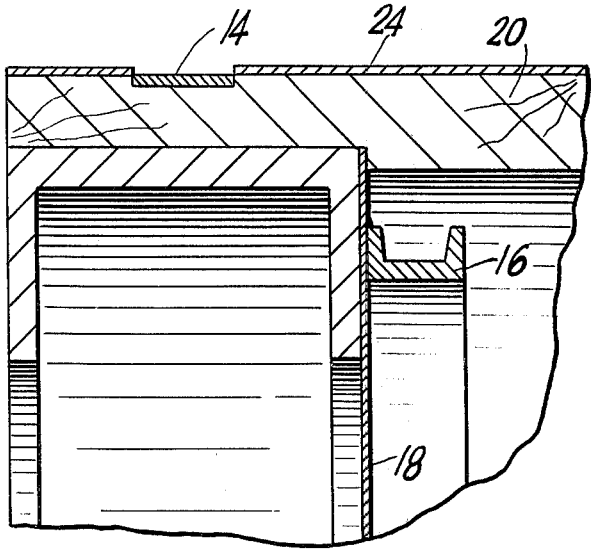
FIG. 2 is an expanded detailed view of portion A shown in FIG. 1 and shown in axial cross-sectional view.
Figure 4:
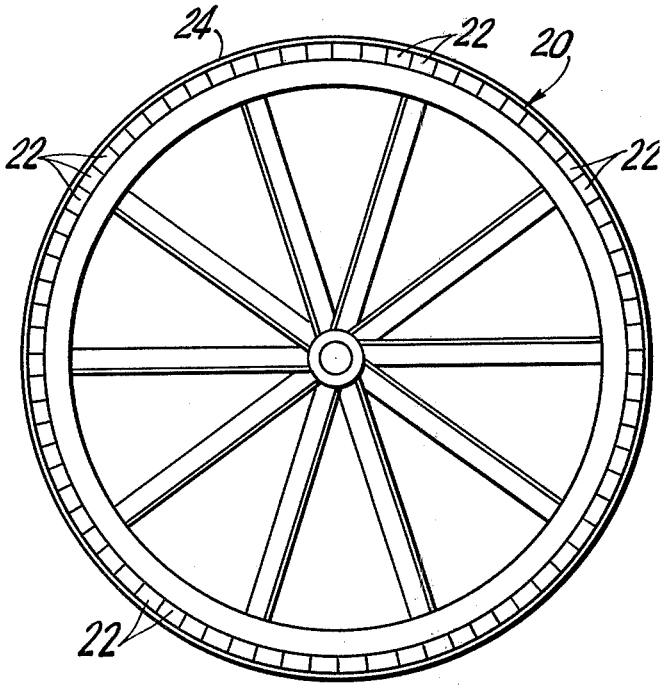
FIG. 4 is a side view of the overall packaging arrangement shown in FIG. 1.

Referring now to FIG. 2, which is an expanded view of portion A shown in FIG. 1, an annular channel member 16 is supported on the inside radial face 18 of the cable reel. The channel may be approximately ⅜ inch high and ¾ inch wide. The outer wooden casing 12 may comprise wood lagging 20 which is shown in end view in FIG. 4 to comprise a series of planks 22.

A three-ply covering 24 is disposed over the lagging 20 and, preferably, comprises plywood with cardboard covering the upper and lower surfaces thereof and attached thereto by marine glue or the like.

Figure 3:
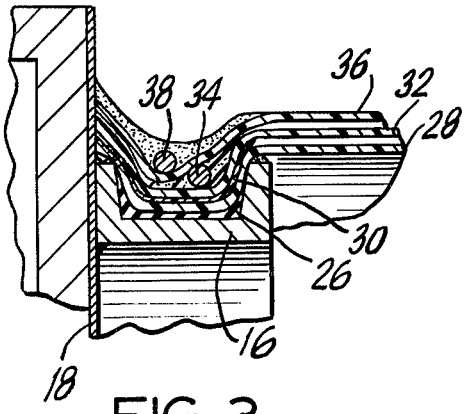
FIG. 3 is a diagrammatic view of the portion of the packaging shown in FIG. 2 with blankets and wires arranged in accordance with the present invention.

Referring to FIG. 3, an adhesive 26 is first disposed within the annular channel 16. The adhesive 26 may comprise a composition of approximately 37% synthetic rubber, resins and rosin and approximately 63 % acetone. Then, a first blanket 28 is disposed about the circumference of the reel with the cable in place. The blanket 28 may comprise a three ply, 6–8 mils thick, pliable sheet. The blanket 28 preferably would comprise a first layer of spun bonded polyolefin, a center layer of aluminum foil and an inside layer of polyethylene. The blanket 28 should be approximately eight inches wider than the reel inside axial dimension. The overall length of the blanket which extends about the circumference of the reel should overlap by about ten inches and a heat sealed seam formed at the area of overlap.

A second layer of adhesive 30 is disposed over the first blanket 28 in the area of the channel which adhesive 30 may comprise the same composition as the adhesive 26.

A second blanket 32 is provided circumferentially about the first blanket and adhesive in the same manner as the first blanket 28. The blanket 32 may be of the same composition as the blanket 28.

A steel banding wire is then provided and then tightly secured over the second blanket to impinge radially inwardly against the first and second blankets 28 and 32. A thick layer of adhesive is provided to generally cover the wire 34 and that portion of the second blanket 32 which falls within the channel member 16.

A third blanket 36 is then provided to cover the entire composite which has been developed to this point. The third blanket 36 may comprise a three-ply, one pound per square foot fabric having an outer layer of poly vinyl chloride, a central layer of Nylon and an inside layer of polyvinyl chloride. The third blanket 36, which is also the outside blanket, is circumferentially arranged about the reel generally in the same manner as the blankets 32 and 28.

A second steel wire 38 is provided and impinges radially inwardly against the composite described above and may be spaced axially from the first steel wire 34.

The general area around the wire 38 and the blanket 36 generally above the channel 16 is then covered in with what is known in the trade as Aluminum Cold Spray. Such a spray should produce a sealed envelope around an object having a thickness of 30–40 mils when two layers have been applied. Such a spray generally comprises approximately 46% of methylethylketone, 25.6% aceton and 28.4% metallic solids such as aluminum.

In performing the packaging procedure according to the present invention, the reel blanket channels 16 should be cleansed of oil and foreign matter before packaging by wiping the channels with a cloth soaked in adhesive solvent. Silica gel bags may be added by firmly securing them onto the cable end tie ropes.

The first blanket 28 shall be secured in place circumferentially about the reel of cable by the use of adhesive and without steel wire banding. The second blanket 32 will be placed over the first blanket and secured into position with an underlayer of adhesive 30. The second blanket 32 should be positioned such that the horizontally extending heat sealed seam will be made at a 90° angle from the heat sealed seam of the first blanket 28. Steel wire 34 is then used as banding to secure the two blankets 32 and 38 in the channel. After twisting the steel wire ends together, the wires should be trimmed close to the channel. Tape should then be applied to the wire ends to protect the outer blanket 36 from possible damage.

The outer blanket 36 is then placed over and secured to the earlier applied two blankets 32 and 28 with an underlayer of adhesive. The horizontal seam of the outer blanket 36 should be made at a position directly over the seam of the second blanket 32.

A second steel wire 38 should then be wrapped as banding over the three blankets 28, 32 and 36 and tightened in place over the channel 16.

The overall composite now supported within the channel 16 should be sprayed with two coats of a liquid envelope spray such as the Aluminum Cold Spray described above.

It can thus be seen that a unique packaging arrangement has been herein described for long distance marine transportation. The first shipments of cable using such packaging were made on an experimental basis to the Far East and the result of such testing indicated that such packaging is remarkably effective in protecting impregnated paper insulated type cable.

While what has been described herein is a preferred embodiment of the present invention, it is, of course, to be understood that various modifications and changes may be made therein without departing from the invention. It is therefore intended to cover in the following claims all such modifications and changes as may fall within the true spirit and scope of the present invention.

What I claim is:

1. An arrangement for packaging reels of cable for marine overseas shipment wherein each reel has two radial flanges supported in axial spaced relationship and moisture absorbing, impregnated paper insulated cable wound thereon:

an annular retaining means supported generally coaxially with respect to the reel and supported on the inside radially face of each said flange;

the upper surfaces of said retaining means being substantially covered with a first layer of a suitable adhesive;

an inner moisture impervious, pliable sheet forming a vapor barrier blanket;

said inner sheet being wrapped circumferentially about said reel over the cable and said retaining means in the area between said flanges and sized to be of a greater axial width than said axial distance between said flanges and to be of a greater circumferential length than the circumference of the wound cable so as to overlap when wrapped about said reel and cable;

a second layer of a suitable adhesive covering the upper surface of said inner sheet in the area above said retaining means;

a first banding wire urging radially downwardly about each annular retaining means and impinging upon said inner sheet of plastic;

an outer pliable sheet disposed over said inner sheet and said first banding wire, said outer sheet being of a greater axial width than said axial distance between said flanges and having a greater circumferential length so as to overlap when wrapped about said reel and cable; and a second banding wire urging downwardly and spaced axially from said first banding wire, said second banding wire being disposed over said inner and outer sheets of pliable plastic.

2. An arrangement according to claim 1, further including:

an intermediate moisture impervious pliable sheet wrapped circumferentially about said inner sheet and sized to be of greater axial width than said axial distance between said flanges and of a greater circumferential length so as to overlap when wrapped about said reel and cable;

said first banding wire urging radially downwardly about each annular retaining means and impinging upon each said inner and said intermediate sheets of plastic; and an intermediate layer of a suitable adhesive being disposed on said intermediate blanket in the area of said retaining means and generally around said first banding wire.

3. The packaging arrangement according to claim 2, wherein a liquid enveloping spray is applied over said second banding wire and outer pliable sheet of plastic in the area of said annular retaining means.

4. A packaging arrangement according to claim 2, wherein hygroscopic means is provided within said packaging within and around said cable for absorbing whatever moisture may already exist within said cable or which may leak thereinto.

5. A packaging arrangement according to claim 2, wherein said adhesive generally comprises 37% synthetic rubber, resins of rosin and 63% acetone.

6. A packaging arrangement according to claim 2, wherein said inner and intermediate pliable sheets comprise three-ply, vapor barrier blankets having a thickness of 6–8 mils and consists of an outer layer of spun bonded polyolefin, a central layer of aluminum foil and an inside layer of polyethylene.

7. A packaging arrangement according to claim 2, wherein said outer pliable sheet comprises an outer layer of polyvinyl chloride, a central layer of Nylon and an inner layer of polyvinyl chloride, said sheet having a density of approximately one pound per square foot.

8. A packaging arrangement according to claim 3, wherein said liquid envelope spray comprises an Aluminum Cold Spray consisting of approximately 46% methylethylketone, 25.6% acetone and 28.4% metallic solids.

9. A packaging arrangement according to claim 2, wherein an outer casing is provided comprising wood lagging consisting of axially extending planks and an outer skin comprising a three ply covering including outer and inner layers of cardboard and a central layer of plywood.

10. A packaging arrangement according to claim 2, wherein said second banding wire is disposed axially outboard of said first banding wire.

* * * * *